US009951911B2

(12) United States Patent
Dekker et al.

(10) Patent No.: US 9,951,911 B2
(45) Date of Patent: Apr. 24, 2018

(54) LED BULB

(71) Applicant: PHILIPS LIGHTING HOLDING B.V., Eindhoven (NL)

(72) Inventors: Tim Dekker, Eindhoven (NL); Haoyang Shi, Eindhoven (NL); Hendrik Jan Eggink, Eindhoven (NL); Wei Gu, Eindhoven (NL); Quingqing Jiang, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/114,373

(22) PCT Filed: Jan. 19, 2015

(86) PCT No.: PCT/EP2015/050831
§ 371 (c)(1),
(2) Date: Jul. 26, 2016

(87) PCT Pub. No.: WO2015/113842
PCT Pub. Date: Aug. 6, 2015

(65) Prior Publication Data

US 2016/0341370 A1 Nov. 24, 2016

(30) Foreign Application Priority Data

Jan. 29, 2014 (WO) ..... PCT/CN2014/000133
Apr. 9, 2014 (EP) ..... 14164033

(51) Int. Cl.

| | |
|---|---|
| ***F21S 4/00*** | (2016.01) |
| ***F21K 9/237*** | (2016.01) |
| ***F21V 29/00*** | (2015.01) |
| ***F21K 9/90*** | (2016.01) |
| ***F21V 29/60*** | (2015.01) |
| ***F21V 29/78*** | (2015.01) |
| ***F21V 29/83*** | (2015.01) |
| ***F21K 9/232*** | (2016.01) |

(Continued)

(52) U.S. Cl.
CPC ..... *F21K 9/237* (2016.08); *F21K 9/232* (2016.08); *F21K 9/235* (2016.08); *F21K 9/238* (2016.08); *F21K 9/90* (2013.01); *F21V 3/02* (2013.01); *F21V 23/005* (2013.01); *F21V 29/004* (2013.01); *F21V 29/60* (2015.01); *F21V 29/78* (2015.01); *F21V 29/83* (2015.01); *F21Y 2107/40* (2016.08); *F21Y 2115/10* (2016.08)

(58) Field of Classification Search
USPC ..... 362/249
See application file for complete search history.

(56) References Cited

U.S. PATENT DOCUMENTS

| | | | | |
|---|---|---|---|---|
| 2013/0271989 | A1 | 10/2013 | Hussell et al. | |
| 2014/0293603 | A1* | 10/2014 | Barnard | F21V 29/74 362/241 |
| 2014/0375202 | A1* | 12/2014 | Yang | F21V 29/004 313/36 |

FOREIGN PATENT DOCUMENTS

| | | | |
|---|---|---|---|
| EP | 2386789 | A2 | 11/2011 |
| EP | 2650589 | A1 | 10/2013 |
| WO | WO2013007814 | A2 | 1/2013 |

* cited by examiner

*Primary Examiner* — Matthew Mikels
(74) *Attorney, Agent, or Firm* — Akarsh P. Belagodu

(57) ABSTRACT

An LED light bulb has LEDs (32) mounted on a tubular carrier (22) with open ends. The tube (22) functions as a chimney to promote cooling by creating convection currents through the chimney. The cooling can be entirely passive or it may be active by incorporating a fan (50).

19 Claims, 7 Drawing Sheets

(51) Int. Cl.

| | |
|---|---|
| ***F21K 9/238*** | (2016.01) |
| ***F21K 9/235*** | (2016.01) |
| ***F21V 3/02*** | (2006.01) |
| ***F21V 23/00*** | (2015.01) |
| *F21Y 115/10* | (2016.01) |
| *F21Y 107/40* | (2016.01) |

LED BULB

CROSS-REFERENCE TO PRIOR APPLICATIONS

This application is the U.S. National Phase application under 35 U.S.C. § 371 of International Application No. PCT/EP2015/050831, filed on Jan. 19, 2015, which claims the benefit of European Patent Application No. 14164033.4, filed on Apr. 9, 2014, and Chinese Patent Application No. PCT/CN2014/000133, filed Jan. 29, 2014. These applications are hereby incorporated by reference herein.

FIELD OF THE INVENTION

The present invention relates generally to a light emitting diode (LED) bulb, and in particular to cooling an LED lamp.

BACKGROUND

Recently there has been a trend in replacing conventional incandescent light bulbs with LED bulbs. The replacement of conventional incandescent light bulbs with one or more LEDs is desirable because incandescent bulbs are inefficient relative to LEDs, e.g., in terms of energy use and longevity.

LED bulbs also offer the possibility to employ two or more groups or "channels" of LEDs which produce light of different colors, each controllably supplied with predetermined currents to enable the generation and mixing of light to produce general illumination with desired attributes or a desired lighting effect. Thus, LEDs offer more versatile lighting solutions.

While it is desirable to replace incandescent light bulbs with LEDs, there are many lighting fixtures, however, where replacement is difficult because of the operating conditions. In particular, heat management is critical. For example, in domestic lighting applications, a bulb is often recessed into a housing. This is particularly the case for spot lamps.

The standard solution is to provide heat sinking structures for dissipating excess heat.

The price of LED-based bulbs has reached a level that makes it affordable for consumers. There is however fierce competition among manufacturers of these bulbs, and a huge pressure to reduce the cost price of the bulbs. Despite recent cost reductions, LED bulbs are still relatively expensive. This is mainly the result of the price of the components such as the heat sinks, the LEDs, the driver, the printed circuit board (PCB), as well as the cost associated with mounting the components.

A reduction in cost price is made possible for example by using a light source in the form of a linear array of electrically connected LEDs on a thin and narrow flexible substrate. In this way, the LEDs can be mounted (soldered) in a continuous linear process. During the process, also a phosphor can be applied (e.g. by dip-coating and drying). Afterwards, the long line of LEDs can be cut to length.

The length then determines the light output of the bulb. The main problem with this proposition is that such a line of LEDs is difficult to cool.

What is needed is a LED lamp that can be manufactured at low cost but which can also efficiently dissipate heat, and without requiring costly heat sinking structures. However, in the absence of a heat sink, the LED device temperature is driven up resulting in lower performance and lifetime.

SUMMARY OF THE INVENTION

The invention is defined by the claims.

According to an example, there is provided an LED light bulb comprising:

a base which includes an electrical connector;

a light emitting bulb part connected to the base and comprising a sealed enclosure having an outer envelope;

a driver circuit electrically connected to the electrical connector; and a set of LEDs electrically connected to the driver circuit, wherein the LEDs are mounted around a hollow tube which is located within the sealed enclosure, wherein the tube has open ends and thereby defines a flow passageway through the tube directed towards the outer envelope.

By mounting the LEDs around a hollow tube, cooling can be provided by using a convection current air flow through the tube, in addition to thermal radiation from the tube surface. In order to achieve maximal heat transfer from the LEDs to the environment, this flow means the thermal resistance between the LEDs and the outer bulb is increased by initiating an air flow inside the bulb. This air flow is directed towards the outer envelope, so that it is subjected to ambient cooling when near the outer envelope. This design enables a simplified heat sink structure to be used, for example entirely within the light emitting part of the bulb, or it can even avoid the need for a heat sink structure at all. This enables the bulb cost to be reduced.

The hollow tube can have a central elongate axis extending in a top-bottom direction of the bulb. This is found to provide the best cooling function, and it also enables the light output to be made rotationally symmetric. For example, the hollow tube central elongate axis preferably extends along an axis of rotational symmetry of the bulb.

The LEDs can be mounted around the outside of the hollow tube. They then emit light towards the outer surface of the bulb. However, they can be mounted around the inside of the hollow tube, but the tube then needs to have a transparent wall.

The term "around" should be understood accordingly as including mounting around the inside or outside of the tube wall.

The hollow tube is preferably spaced from the outer wall of the light emitting bulb part, with an air flow space radially around the outside of the hollow tube as well as at the ends of the hollow tube. In this way, the hollow tube is mounted in the middle of the bulb rather than at the base, so that convection currents can flow all around the tube.

The hollow tube preferably has a maximum width d and a height h, wherein $h>=d$.

This means the tube is elongate, so that it defines a flow passageway within which directional flow currents can be established. The sealed enclosure can have a maximum width w, wherein $0.3w<d<0.7w$, more preferably $0.4w<d<0.6w$. In this way, some space is provided around the tube, so that circulatory flows can be established along the centre of the tube and around the outside of the tube.

The LEDs can comprise a string of LEDs provided on a flexible substrate wound around the tube. This provides a low cost implementation.

Alternatively, the hollow tube can comprise a flexible circuit board, on which discrete LEDs are mounted. In this way, the substrate of the LEDs itself defines the hollow tube. This reduces the number of components, as the hollow tube is then simply the circuit board which carries the LEDs.

The circuit board may be manufactured in the conventional way, i.e., a single sided, double sided or multilayer construction and preferably uses the panelization procedure. This is a procedure where a number of identical circuits are printed onto a larger board (the panel). The panel is broken into the individual PCBs when all other processing is completed. The separation process is frequently aided by drilling or routing perforations along the boundaries of the individual PCBs, more recently this has been superseded by cutting V shaped grooves around the individual PCBs. This is often completed using a laser which can either cut fully through the board or can make the V shaped grooves without physically contacting the board.

As well as being used to remove a smaller individual PCB from the larger panel it can be seen that a series of V shaped grooves may be made in one face of the individual PCB to allow the PCB to be formed into a 3D shape. In one embodiment, the rear face of the PCB has a number of V shaped grooves to allow the PCB to be folded into the desired shape.

The hollow tube can have an empty centre (i.e. filled with the gas in the bulb). This is particularly desirable for a low cost passive cooling implementation, in which there is only passive cooling using convection current air flows combined with thermal radiation.

Alternatively, a heat sink structure can be mounted within the hollow tube. An embodiment of which is manufactured using the V shaped groove method to allow the PCB to be wound into a hollow tube comprising a first end region that has discrete LEDs mounted on the surface and a second end region which is free of LEDs, the first end region forming an outer tube and the second end portion forming an inner heat sink portion that extends throughout the length of the tube. This enables the outer hollow tube on which the LEDs are mounted, and an inner heat sink contained within the hollow tube, to be formed as a single component.

This embodiment has better heat transfer capabilities by virtue of having a larger surface area for heat dissipation than an embodiment where the inner heat sink portion only extends a shorter way along the centre axis of the hollow tube.

Such a heat sink structure may impede the gas flow through the hollow tube, and this structure may be of particular interest for an active cooling implementation in which a fan or other flow device is used to drive an air flow through the tube.

The circuit board can comprise a series of sections between the ends with fold regions between adjacent sections, wherein the outer tube comprises a polygon with a first number n of sides each comprising one of the sections, and the inner heat sink portion comprises a polygon with a second number m of sides each comprising one of the sections. This defines a structure of one polygonal cylinder within another, formed from a single coiled circuit board.

Preferably m=n−1 or m=n−2. By having the inner tube with fewer sides, the sides (i.e. the circuit board sections) can have the same length, so that the circuit board has a regular structure.

When a flow device is used, it can be located at the base part for providing an active cooling air flow through the centre of the hollow tube. The flow device can be an electric fan, a synthetic jet cooling device or piezoelectric blade fan for example.

An alternative method of manufacturing the PCB is known as printed electronics. These are a set of printing methods that are used to create electrical devices on various substrates. This can allow the manufacture of flexible circuit boards if a suitable substrate is used.

For the preparation of printed electronics nearly all industrial printing methods are employed. One important benefit of printed electronics is low-cost volume production. The printing technologies generally divide between sheet-based and roll to roll-based approaches but an aerosol based deposition technology may also be used.

According to a second aspect of the invention, a method of manufacturing an LED bulb is disclosed. The method comprises the following steps;

providing a base (15) which includes an electrical connector (16), providing a light emitting bulb part (14), providing a driver circuit (18) which is electrically connected to the electrical connector (16), providing a hollow tube (22) comprising a circuit board, wherein discrete LEDs (32) are mounted on a first end region of the circuit board, locating the hollow tube (22) proximate to the base (15), connecting the light emitting bulb part (14) to the base (15) thus forming a sealed enclosure, the sealed enclosure comprising an outer envelope which is located around the hollow tube (22).

BRIEF DESCRIPTION OF THE DRAWINGS

Examples of the invention will now be described in detail with reference to the accompanying drawings, in which.

DETAILED DESCRIPTION

Figure 1:
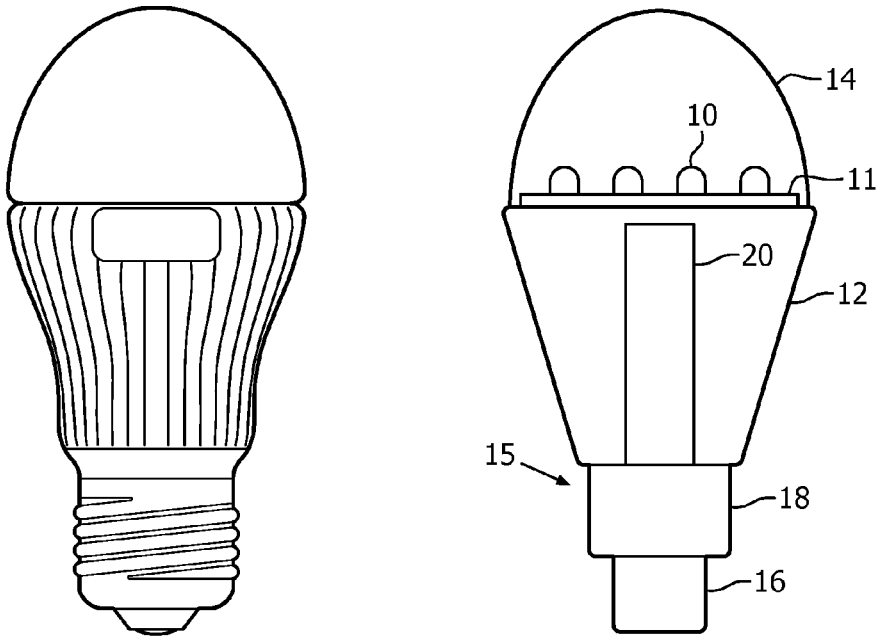
FIG. 1 shows a known LED light bulb.

FIG. 1 shows known LED-based alternative to incandescent light bulbs, particularly A55 and A60 types. The outer appearance is shown on the left, and the internal components are shown schematically on the right. This is known as the MASTER LEDbulb available from Koninklijke Philips N.V. The blub includes a plurality of LED light sources 10 provided on a circuit board 11, which is disposed over a heat sink 12. The LEDs emit dimmable light towards a diffusing dome cover 14.

The bulb has a base which includes an electrical connector 16 and driver circuitry 18 which connects to the LEDs through conduit 20. The driver circuitry comprises an AC/DC converter that converts the AC power from the electrical connector to DC power. In this example, the driver circuitry additionally comprises dimming control circuitry, for example implemented using pulse width modulation (PWM). However, dimming control is not an essential function.

The heat sink 12 is a significant contributor to the cost of the bulb.

The invention provides an LED light bulb in which an airflow is created inside the bulb, by mounting the LEDs on a hollow tube. The tube is open at both ends. This configuration can be considered to define a heat chimney.

Figure 2:
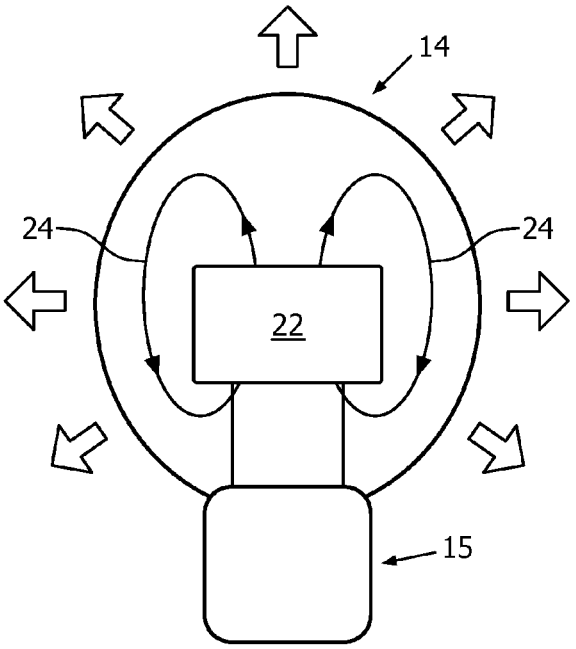
FIG. 2 shows in schematic form the concept underlying the LED bulb of the invention for a low cost passive cooling implementation.

FIG. 2 shows the concept underlying a first set of examples of the LED light bulb of the invention. The same reference numbers are used as in FIG. 1 for the same components.

The LEDs are mounted on a cylindrical carrier 22 with open ends. In the example shown, the carrier is oriented in the top-bottom direction of the bulb. The LEDs can be on the outer surface or the inner surface (which requires the carrier to be transparent). However, in either case, there is thermal coupling of the LEDs to the space within the cylinder. The cylinder functions as a chimney.

The heating of air within the cylinder, combined with the cooling of the air near the outer edge of the bulb where there is thermal coupling to the ambient surroundings, creates convection currents within the bulb volume. These currents are shown as 24. Thus, when the LEDs are operated, the chimney heats up, pushing hot air out of one end of the chimney. The airflow lowers the thermal resistance between the chimney and the outer envelope of the bulb. The open structure allows for the two surfaces (inner tube and outer envelope) to take part in the heat transfer.

The structure shown in FIG. 2 enables passive cooling to be used, so that heat sink structures can be simplified or they can be avoided altogether. This enables a low cost solution. For a passive cooling implementation, the cylinder has open ends, and has an empty central volume. The cylinder cross section can be circular or polygonal. Thermal analysis of the structure of FIG. 2 is given further below.

The passive cooling approach provides one set of examples, which is of particular interest for enabling the lowest cost implementation.

A second set of examples makes use of active cooling.

Figure 3:
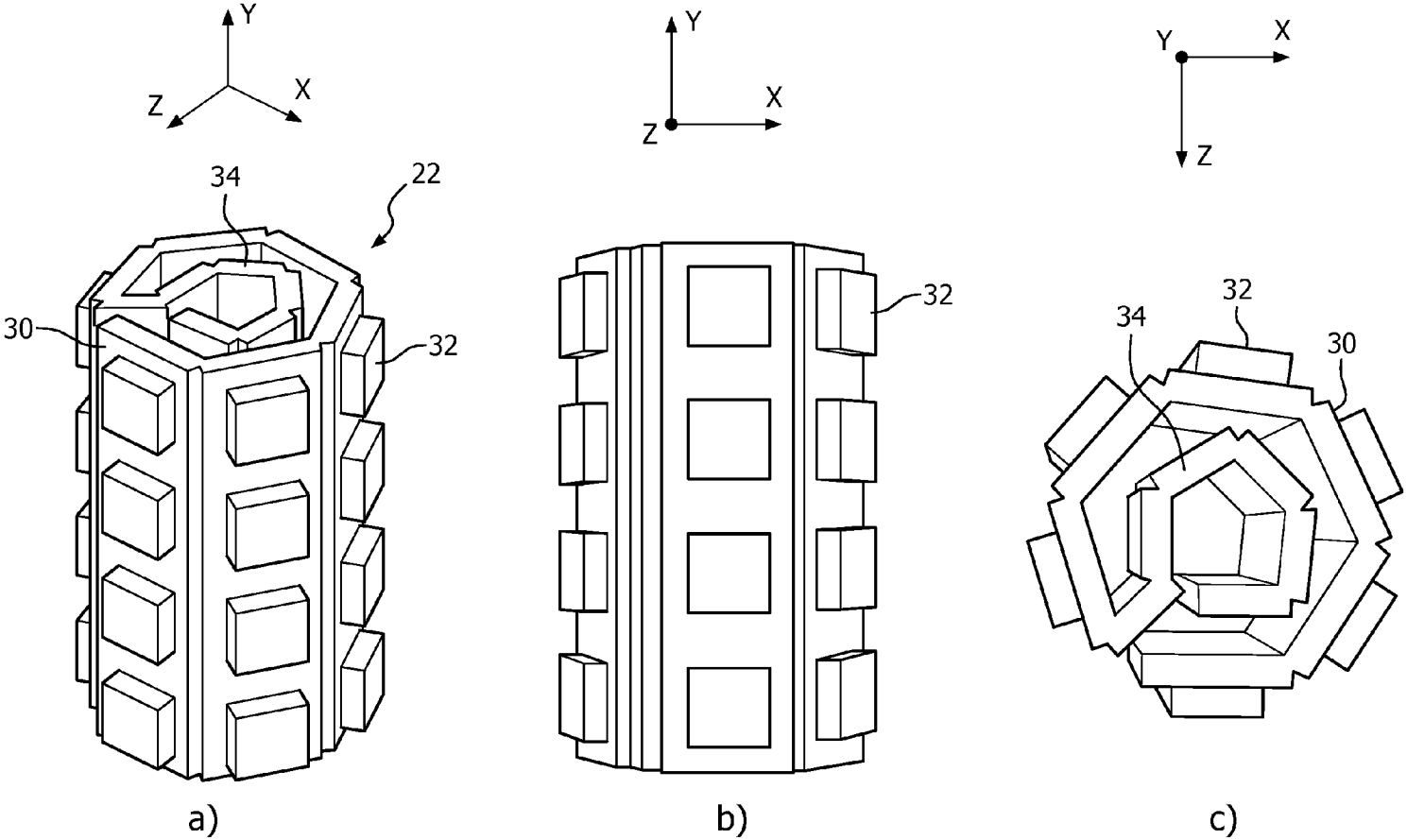
FIG. 3 shows a first example of LED unit for a light bulb of the invention for an active cooling implementation.

FIG. 3 shows an example of the design of the carrier 22 which is of particular interest for an active cooling implementation, and in which the cylinder includes a heat sink structure. It is noted, however, that the structure of FIG. 3 can be used in a passive cooling implementation if the convection flows are found to be sufficient despite the additional flow resistance resulting from the heat sink structure.

FIG. 3(*a*) shows a perspective view, FIG. 3(*b*) shows a side view and FIG. 3(*c*) shows an end view.

The carrier 22 comprises a planar substrate in the form of a metal core PCB (MCPCB) which is wound to define an outer periphery 30 on which the LEDs 32 are mounted. MCPCBs are known for mounting high power LEDs, and they include a central metal core for improved thermal dissipation. The metal core is typically aluminium or copper. The inside of the cylinder defined in this way can be completely empty. However, the example of FIG. 3 shows that one end of the planar substrate is used to form a further cylinder 34 within the main LED-carrying cylinder 30. This further cylinder 34 functions as a heat sink.

Note that other carriers can be used such as a flexi-foil substrate, or PCB materials (such as the glass reinforced epoxy laminate known as FR4 and the composite epoxy material known as CEM3) with a single copper layer.

Figure 4:
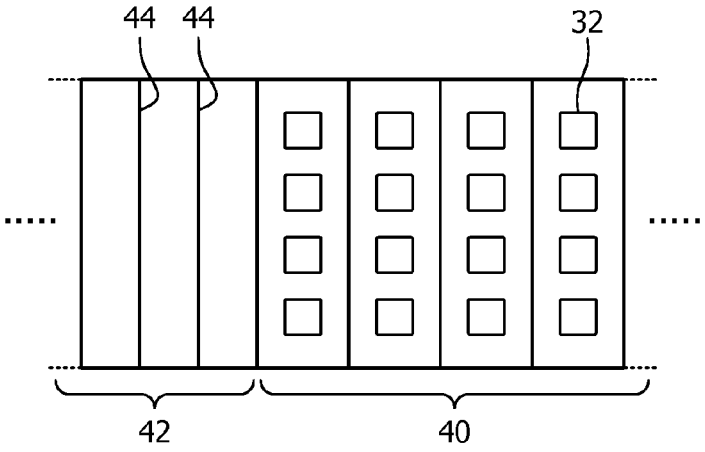
FIG. 4 shows the LED unit of FIG. 3 in planar form.

FIG. 4 shows the substrate design before winding, comprising an MCPCB. One end 40 carries the LEDs 32 as discrete mounted components and the other end 42 carries no LEDs. This end is used to define the heat sink part 34.

The substrate has fold lines 44 so that the substrate can be folded into a polygon. In the example shown in FIG. 3, the inner cylinder 34 forms a pentagon, so that the end 42 has six sections (one to join the inner cylinder 34 to the main cylinder, and five to form the sides of the pentagon). The LED end 40 has six sections to form a hexagonal main cylinder.

This is just one example. The main cylinder can have as few as three sides, and typically up to eight. The inner cylinder can have the same number of sides, although this requires the sections to be narrower in the end 42 than in the end 40. If the sections are all the same width (as in the example shown), the inner cylinder can typically have one or two fewer sections than the main cylinder.

Figure 5:
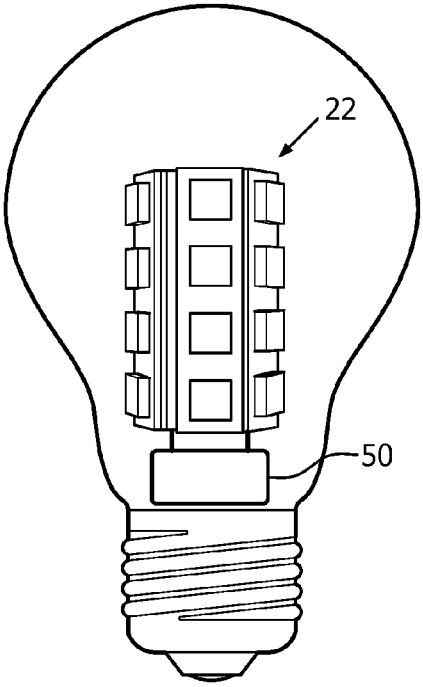
FIG. 5 shows the LED unit of FIG. 3 within a bulb to form an LED light bulb.

FIG. 5 shows the carrier 22 mounted inside a glass bulb.

The carrier can be mounted horizontally or vertically. However, improved convection flow is induced with a vertical orientation.

As explained above, in a first set of examples, the cooling is passive. In this case, the convection current air flow essentially provides improved thermal coupling between the LEDs in the centre of the bulb and the outer surface of the bulb where heat is dissipated to the ambient surroundings.

In a second set of examples, the cooling is active. In this case, a flow device such as a fan can be mounted within the bulb to drive an air flow through the carrier. The carrier is preferably vertical in this case, so that a fan can be provided in the base of the bulb, which directs an air flow vertically up the centre of the carrier to induce an increased airflow as shown in FIG. 2. The fan is shown in FIG. 5 as unit 50. The flow device can be a conventional electric fan, a synthetic jet cooling device or piezoelectric blade fan for example.

Thermal calculations have been performed to validate the advantage of the passive cooling chimney concept, by comparing the heat distributions for an open ended tube, a tube with a closed end, and a heat sink structure which does not create a flow passageway. Firstly, it is clear from comparing the chimney or open cylinder with a closed cylinder or a cross geometry under different orientations that the chimney concept has on average the lowest thermal resistance. Analysis of the heat flow distribution shows that the heat flow from the LED sources to the outside surface of the bulb takes place as 57% convection and 43% radiation. The cylinder edges of the cylinder carry 5% of the total heat load, the inner surface has 30% and the outer surface has 65%. The conclusion is that the flow through the inside of the cylinder plays an important role in the heat transfer. The inner surface takes also part in the radiation heat transfer.

The thermal efficiency of the design has been tested by thermal analysis.

Figure 6:
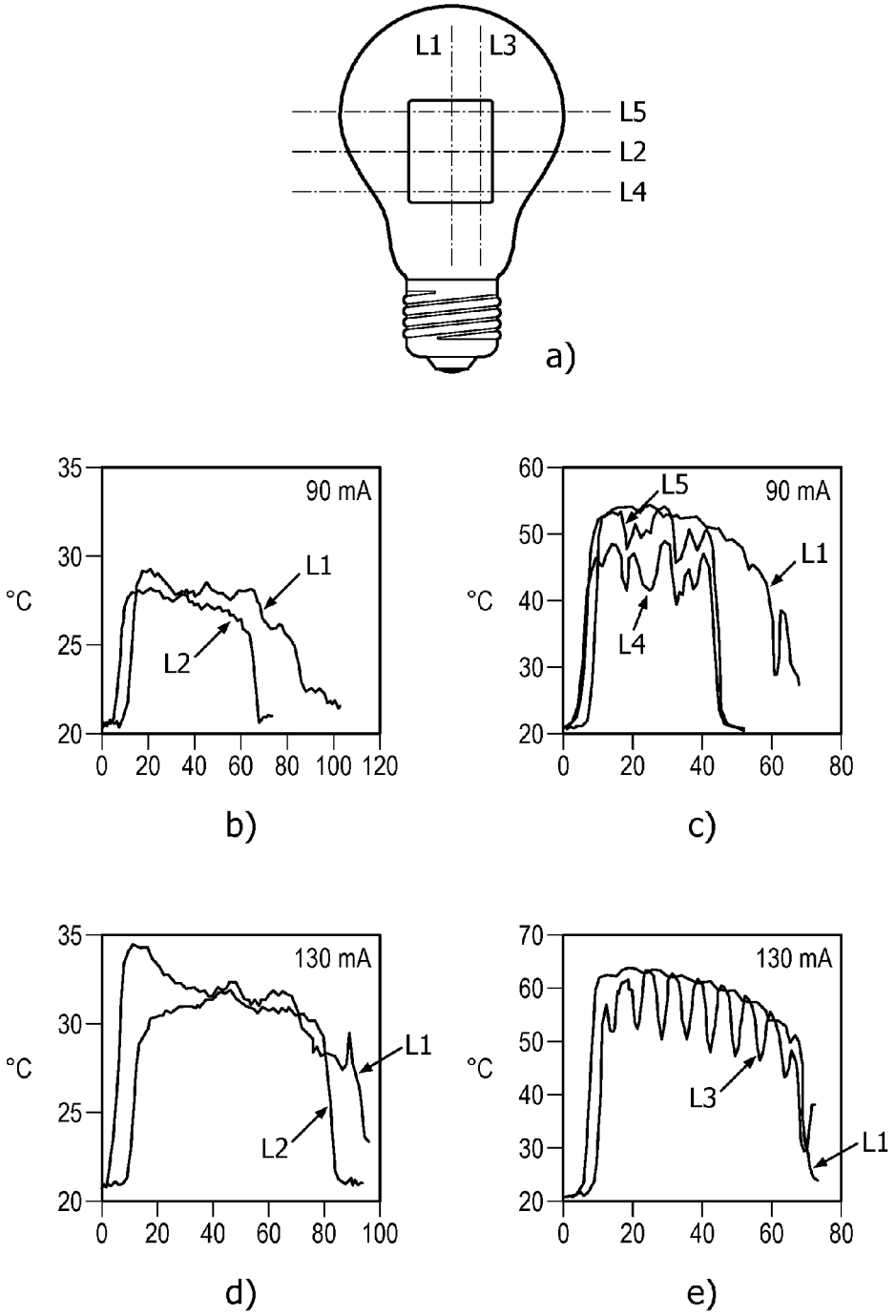
FIG. 6 shows some results of thermal tests carried out on a first design of LED bulb of the invention.

FIG. 6 shows results for an example design.

The design has a cylinder diameter of 24 mm and a cylinder height of 30 mm.

FIG. 6(*a*) shows the general bulb shape. The lines L1 to L5 show axes along which thermal gradients are plotted in FIGS. 6(*b*) to 6(*e*). Line L1 passes vertically through the centre of the carrier 22. Line L2 passes horizontally across the centre of the carrier 22. Line L3 passes vertically along an outer edge of the carrier 22. Line L4 passes horizontally across the lower end of the carrier 22. Line L5 passes horizontally across the upper end of the carrier 22.

FIG. 6(*b*) shows plots for lines L1 and L2 with a driving current of 90 mA.

FIG. 6(*c*) shows plots for lines L1, L4 and L5 with a driving current of 90 mA.

The thermal measurements were taken using infrared imaging. To take the images, the cylinder is removed from the bulb enclosure immediately before taking the image, since the images cannot be taken though the glass enclosure.

FIG. 6(*d*) shows plots for lines L1 and L2 with a driving current of 130 mA. The increased driving current gives rise to an increase in temperature compared to FIG. 6(*b*).

FIG. 6(*e*) shows plots for lines L1 and L3 with a driving current of 130 mA. The L3 plot has undulations because the line L3 crosses the solder spots of a line of LEDs to the carrier.

Figure 7:
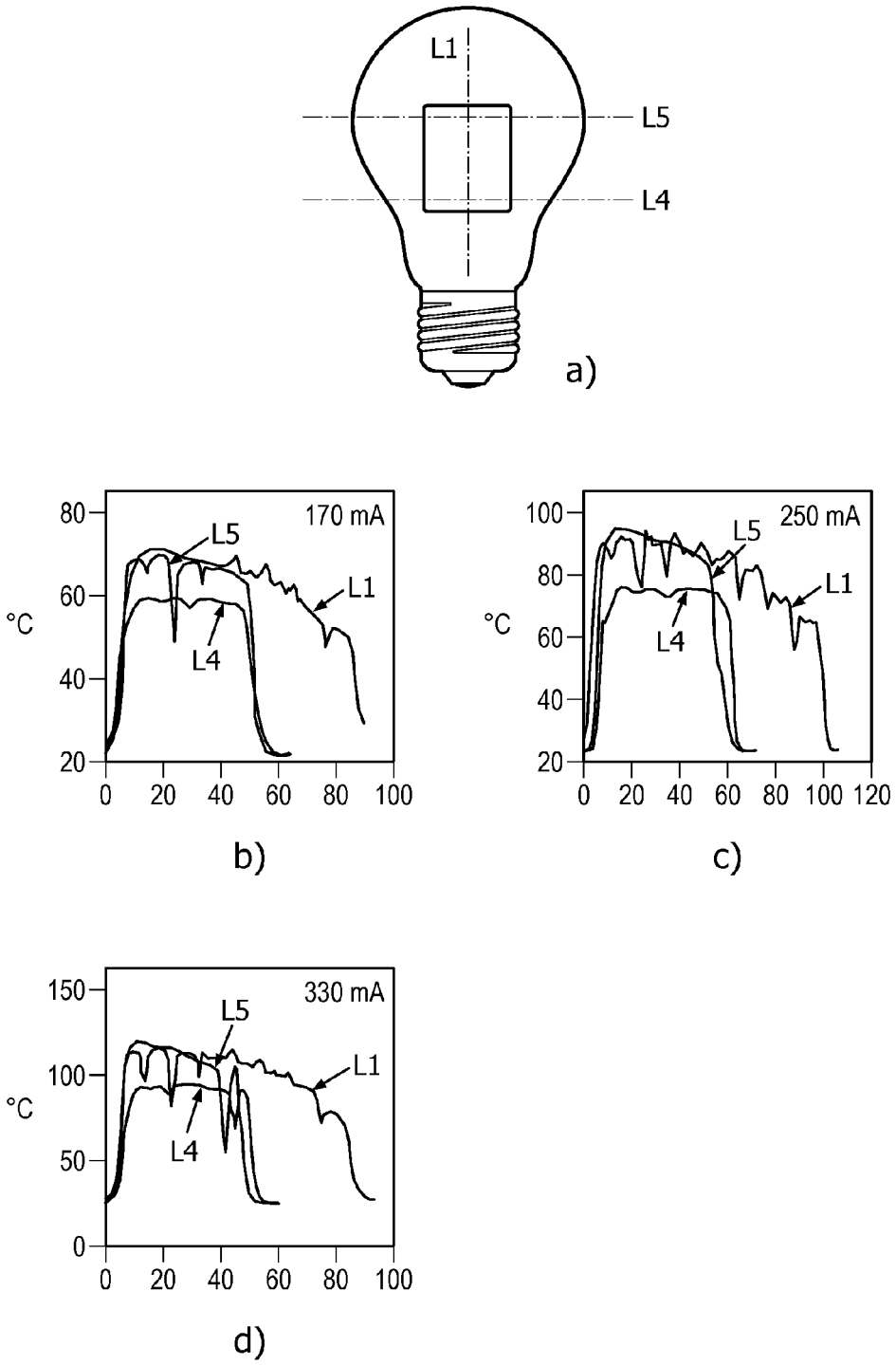
FIG. 7 shows further results of the thermal tests.

FIG. 7 shows further results for increased driving currents.

FIG. 7(*a*) shows the general bulb shape and corresponds to FIG. 6(*a*), although only lines L1, L4 and L5 are used for the plots of FIGS. 7(*b*) to 7(*d*).

FIG. 7(*b*) shows plots for lines L1, L4 and L5 with a driving current of 170 mA. FIG. 7(*c*) shows plots for lines L1, L4 and L5 with a driving current of 250 mA. FIG. 7(*d*) shows plots for lines L1 and L2 with a driving current of 330 mA.

These thermal analyses have been used to demonstrate the effectiveness of the passive cooling mechanism. The plots along line L1 in particular show that there are significant temperature gradients along the cylinder axis which demonstrates that there are convection current cooling effects.

High lumen lamps can be created and effectively cooled, such as 2000 lm to 5000 lm.

By analysing different designs, it has been found that for a given cylinder surface area, a shorter cylinder with larger diameter is found to achieve better cooling.

Figure 8:
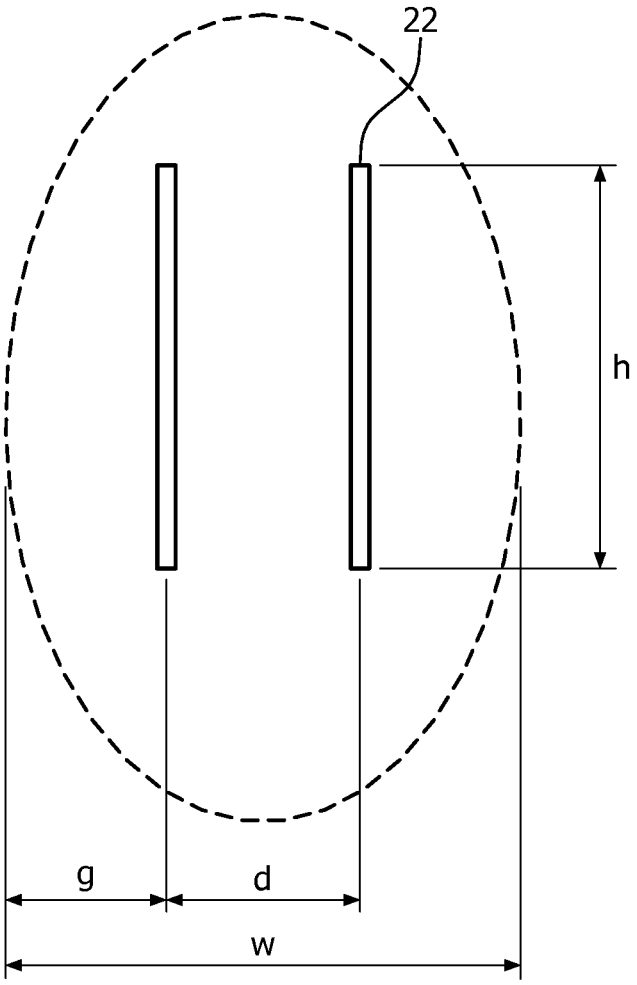
FIG. 8 shows some design parameters for designing the LED light bulb of the invention.

FIG. 8 shows the cylinder diameter as d and the height as h. The maximum horizontal gap between the cylinder and the edge of the bulb is g (on each side).

The diameter of the cylinder should essentially be as large as possible for a given area. For example, the diameter should be in the range of 30% to 70% of the internal diameter of the bulb, so that large air flow channels are defined within the cylinder and around the outsides. With reference to FIG. 8, $0.3\ (d+2g)<d<0.7\ d+2g$). The internal diameter is shown as w, i.e. $w=d+2g$.

To define three channels of equal maximum width, d=66% of the internal diameter. To define three channels, with the inner channel twice as wide as the maximum outer channel width (since the two outer channels combine in the cylinder) d=50% of the internal diameter of the bulb. A more preferred range is $0.4\ (d+2g)<d<0.6\ (d+2g)$.

The height of the cylinder will be selected to provide space for the number of LEDs desired. However, some height is required to create a chimney effect. Preferably, $h>=d$.

By way of example, the diameter may be in the range 10 mm to 30 mm, and the height may be in the range 20 mm to 50 mm.

Some possible examples are:

d=20 mm, h=20 mm d=16 mm, h=25 mm d=10 mm, h=40 mm d=20 mm, h=40 mm

Simulations have also been carried out, which show that the cooling mechanism can be used for heat loads up to 4 W, based on an ambient temperature of 25 degrees. In order to verify the cooling mechanism, the bulb geometry has been simplified to a spherical 60 mm diameter outer bulb. To take account of a typical neck diameter of the outer bulb of 25 mm, a tube outer diameter of 20 mm is assumed (and inner diameter 18 mm). The LED light source is modelled as a cylinder with a distributed heat source over the outer cylinder area, and the heat source output is based on modelling the heat characteristics of LEDs.

Different tube lengths are modelled, such as 20 mm and 30 mm.

Figure 9:
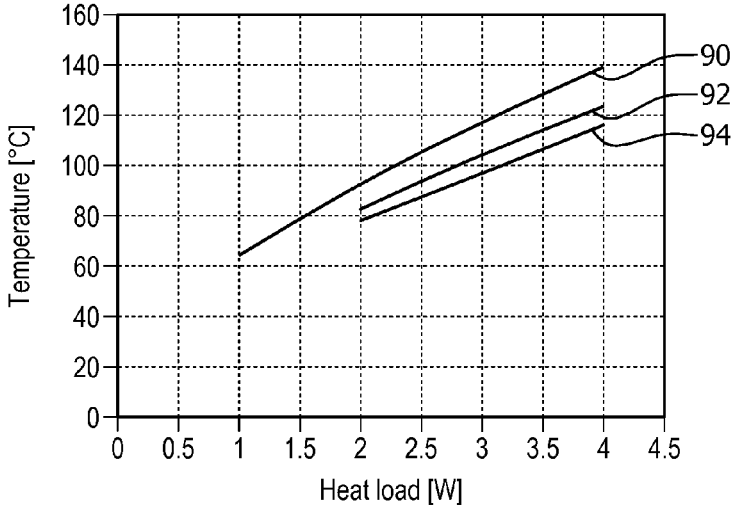
FIG. 9 shows the cooling effect of various examples of LED tube design used in the LED bulb.

FIG. 9 shows the results, and plots the temperature of the light source for three passive cooling simulations. Plot 90 is for a 20 mm diameter tube with length 20 mm. Plot 92 is for a 20 mm diameter tube with length 30 mm. Plot 94 is for a 20 mm diameter tube with length 30 mm with an additional elongate heat sink in the centre of the tube with a cross-shaped cross section.

The cooling can for example be aimed at providing sufficient cooling to prevent the light source temperature exceeding 115 degrees. As shown, the longer tube provides improved cooling, and the heat sink provides additional benefit. Assuming a 115 degree maximum, plot 90 enables the required cooling up to a power of around 2.8 W, plot 92 enables the required cooling up to a power of around 3.7 W, and plot 94 enables the required cooling up to a power of around 4.0 W.

Figure 10:
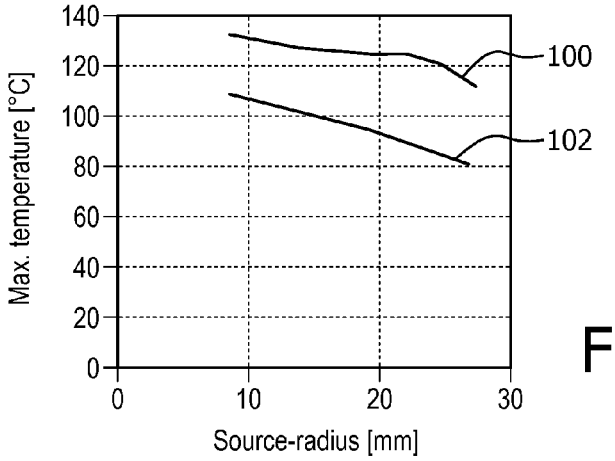
FIG. 10 shows the effect on the cooling properties for cylinders with different ratio between diameter and height.

As mentioned above, the chimney height and diameter influence the cooling properties. FIG. 10 shows the effect on the cooling properties for cylinders with different ratio between diameter and height. The maximum temperature is plotted for a fixed power applied to the LED arrangement. The lower the maximum temperatures, the more effective the cooling. Plot 100 shows how the cooling effect varies for different radius cylinder, while maintain a constant surface area (so that as the radius is increased, the height is decreased). Plot 102 shows the result for the same size and shape cylinder but filled with helium. In general, a larger radius is preferred.

Figure 11:
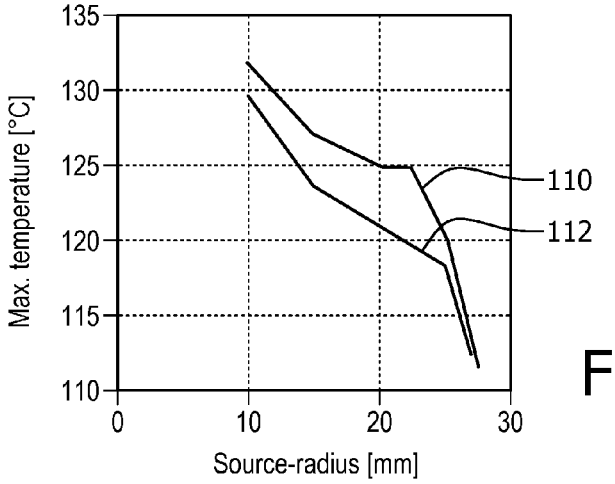
FIG. 11 shows the effect on the cooling properties for cylinders with different cross sectional shapes.

The cylinder can have various cross sectional shaped. FIG. 11 shows the effect on the cooling properties for cylinders with different cross sectional shapes. Plot 110 is for a circular cylinder, and plot 112 is for an octagonal cylinder with the same maximum diameter (both for air filled bulbs).

In the example above, the tube functions as the circuit board for the LEDs. In another example, the LEDs can comprise a string of LEDs provided on a flexible substrate. This flexible substrate can then be wound around the surface of the tube. In particular, there is contact with the tube to provide thermal coupling between the LED substrate and the hollow centre of the tube which provides an air flow passageway. This design means that the bulb is particularly easy and low-cost to make. The cylinder can be pre-assembled with the linear LED array into a component that can be inserted and glued into the bulb easily. The LEDs can be in good thermal contact with the tube by using a thermal adhesive.

In the examples above, the tube is a straight passageway running in a direction from the top to bottom of the light emitting part of the bulb. However, the tube may take other forms and orientations.

The outer envelope of the bulb is preferably glass, and can be designed with scattering properties to mask the appearance of the discrete LEDs inside. However, a clear outer envelope can also be used. If the LEDs are provided on the inside surface of the tube, the tube itself can have scattering properties, so that a clear outer envelope can be used.

In other configurations, a clearer tube can also be used. For instance, the tube can be transparent, so that the LEDs provided on the inside or outside surface thereof can appear to an observer as being floating in the inside of the bulb.

The outer envelope can be made from materials other than glass, such as plastic or a translucent ceramic such as a densely sintered alumina.

The outer envelope can be filled with air, or it may be filled with a gas, such as helium. This can promote a more even temperature over the bulb surface. Other gas fillings can be used, such as helium and carbon dioxide, or helium and propane.

The bulb of the invention can be designed with any desired shape. In particular, the existing A55 and A60 geometries of incandescent bulbs can be used, and the LED bulb can then function as a direct replacement for those bulb configurations.

It is noted that the use a fan for cooling within a bulb is known. An axial electric fan can be used for this purpose, driven by an electric motor. The motor may be, by way of example, a brushless DC 12 V motor and receives power from an AC/DC converter which forms part of the driver circuitry. The type and size of the motor and fan will depend on the size of the LED lamp and the type of LED and how much heat is produced by the LED. The fan circulates air flow within the sealed bulb enclosure, and thus simply enhances the convection currents which can be relied upon in a passive cooling system.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. An LED light bulb comprising:

a base which includes an electrical connector;

a light emitting bulb part connected to the base and comprising a sealed enclosure having an outer envelope;

a driver circuit electrically connected to the electrical connector; and a set of LEDs electrically connected to the driver circuit, wherein the LEDs are around a hollow tube which is located within the sealed enclosure, wherein the tube comprises a circuit board further comprising a series of sections with fold regions between adjacent sections, said circuit board having a first end region on which discrete LEDs are mounted and a second end free of LEDs, wherein the first end region is shaped to define an outer tube, and the second end region is shaped to define an inner heat sink portion within the outer tube, said inner heat sink portion and said outer tube having open ends and thereby defining a flow passageway through the inner heat sink portion and the outer tube directed towards the outer envelope.

2. A bulb as claimed in claim 1, wherein the hollow tube has a central elongate axis extending in a top-bottom direction of the bulb.

3. A bulb as claimed in claim 1, wherein the hollow tube central elongate axis extends along an axis of rotational symmetry of the bulb.

4. A bulb as claimed in claim 1, wherein the LEDs are mounted around the outside of the hollow tube or around the inside of the hollow tube.

5. A bulb as claimed in claim 1, wherein the hollow tube has scattering properties or is transparent.

6. A bulb as claimed in claim 1, wherein the hollow tube is spaced from the outer wall of the light emitting bulb part, with an air flow space radially around the outside of the hollow tube as well as at the ends of the hollow tube.

7. A bulb as claimed in claim 1, wherein the hollow tube has a maximum width d and a height h, wherein $h>=d$.

8. A bulb as claimed in claim 7, wherein the sealed enclosure has a maximum width w, wherein $0.3w<d<0.7w$, more preferably $0.4w<d<0.6w$.

9. A bulb as claimed in claim 1, wherein the LEDs comprise a string of LEDs provided on a flexible substrate wound around the hollow tube.

10. A bulb as claimed in claim 1, wherein the hollow tube comprises a flexible circuit board, on which discrete LEDs are mounted.

11. A bulb as claimed in claim 10, wherein the circuit board comprises a series of sections between the ends with fold regions between adjacent sections, wherein the outer tube comprise a polygon with a first number n of sides each comprising one of the sections, and the inner heat sink portion comprises a polygon with a second number m of sides each comprising one of the sections.

12. A bulb as claimed in claim 11, wherein $m=n-1$ or $m=n-2$.

13. A bulb as claimed in claim 1, further comprising an air flow device located at the base part for providing an active cooling air flow through the center of the hollow tube.

14. A method of manufacturing an LED bulb according to claim 1 wherein the method comprises the following steps;

providing a base which includes an electrical connector;

providing a light emitting bulb part;

providing a driver circuit which is electrically connected to the electrical connector;

providing a hollow tube comprising a circuit board having a first end region and a second end region, said circuit board further comprising a series of sections with fold regions between adjacent sections;

mounting a plurality of discrete LEDs to the first end region of the circuit board;

forming the circuit board such that the first end region is shaped to define an outer tube and the second end region is shaped to define an inner heat sink portion within the outer tube, both inner heat sink portion and outer tube having open ends to define a flow passageway through the inner heat sink portion and the outer tube;

locating the outer tube proximate to the base; and connecting the light emitting bulb part to the base thus forming a sealed enclosure, the sealed enclosure comprising an outer envelope which is located around the outer tube.

15. A bulb as claimed in claim 1, wherein the circuit board is coiled by way of the fold regions such that the first end region defines the outer tube as an outer polygonal cylinder and the second end region defines an inner polygonal cylinder within the outer polygonal cylinder, said inner polygonal cylinder and said outer polygonal cylinder defining the flow passageway through the inner polygonal cylinder and the outer polygonal cylinder directed towards the outer envelope, wherein the inner polygonal cylinder operates as the inner heat sink.

16. An LED light bulb comprising:

a base which includes an electrical connector;

a light emitting bulb part connected to the base and comprising a sealed enclosure having an outer envelope;

a driver circuit electrically connected to the electrical connector; and a set of LEDs electrically connected to the driver circuit, wherein the LEDs are mounted on a circuit board that includes a series of sections with fold regions between adjacent sections, said circuit board having a first end region on which discrete LEDs are mounted and a second end region opposite the first end region that is free of LEDs, wherein the circuit board is coiled by way of the fold regions such that the first end region defines an outer polygonal cylinder and the second end region defines an inner polygonal cylinder within the outer polygonal cylinder, said inner polygonal cylinder and said outer polygonal cylinder defining a flow passageway through the inner polygonal cylinder and the outer polygonal cylinder directed towards the outer envelope, wherein the inner polygonal cylinder operates as an inner heat sink.

17. A bulb as claimed in claim 16, wherein a longitudinal axis of the inner polygonal cylinder is parallel to a longitudinal axis of the outer polygonal cylinder.

18. A bulb as claimed in claim 17, wherein the fold regions comprise fold lines that are parallel to the longitudinal axes of the inner and outer polygonal cylinders.

19. A bulb as claimed in claim 16, wherein the outer polygonal cylinder comprises a polygon with a first number n of sides each comprising one of the sections, and the inner polygonal cylinder comprises another polygon with a second number m of sides each comprising one of the sections.

* * * * *